US007446710B2

(12) United States Patent
Wu et al.

(10) Patent No.: US 7,446,710 B2
(45) Date of Patent: Nov. 4, 2008

(54) INTEGRATED LTCC MM-WAVE PLANAR ARRAY ANTENNA WITH LOW LOSS FEEDING NETWORK

(75) Inventors: Ke-Li Wu, Hong Kong SAR (CN); Yong Huang, Hong Kong SAR (CN)

(73) Assignee: The Chinese University of Hong Kong, Hong Kong Sar (CN)

( * ) Notice: Subject to any disclaimer, the term of this patent is extended or adjusted under 35 U.S.C. 154(b) by 306 days.

(21) Appl. No.: 11/384,179

(22) Filed: Mar. 16, 2006

(65) Prior Publication Data

US 2006/0256016 A1 Nov. 16, 2006

Related U.S. Application Data

(60) Provisional application No. 60/663,139, filed on Mar. 17, 2005.

(51) Int. Cl.
*H01Q 1/38* (2006.01)

(52) U.S. Cl. ..... 343/700 MS; 343/853

(58) Field of Classification Search ..... 343/700 MS, 343/829, 846, 853
See application file for complete search history.

(56) References Cited

U.S. PATENT DOCUMENTS 5,497,164 A 3/1996 Croq
5,708,444 A * 1/1998 Pouwels et al. ..... 343/700 MS
5,880,694 A * 3/1999 Wang et al. ..... 343/700 MS
6,809,688 B2 * 10/2004 Yamada ..... 343/700 MS
7,058,362 B1 * 6/2006 Khorrami et al. ..... 455/66.1

FOREIGN PATENT DOCUMENTS

EP 1 120 856 A1 1/2001
JP 11-298241 10/1999

OTHER PUBLICATIONS

PCT written opinion of the international searching authority issued on Jun. 29, 2006.

* cited by examiner

*Primary Examiner*—Tho G Phan
(74) *Attorney, Agent, or Firm*—Knobbe Martens Olson & Bear LLP

(57) ABSTRACT

An array antenna comprises a first substrate comprising a first plurality of ceramic layers; a second substrate comprising a second plurality of ceramic layers; a bottom ground plane stacked on the bottom of the second ceramic substrate; a plurality of quasi-cavity-backed patch antennas mounted on a top surface the first substrate, each of the patch antennas including a radiating element and two grounded grid-like conductor walls; and a mixed feeding network coupled to each of the patch antennas. The array antenna working at mm-wave frequency band can provide high radiation efficiency and low loss from feeding network by using quasi-cavity-backed patch elements and a mixed feeding network configuration.

17 Claims, 5 Drawing Sheets

INTEGRATED LTCC MM-WAVE PLANAR ARRAY ANTENNA WITH LOW LOSS FEEDING NETWORK

This application claims the benefit of U.S. provisional patent application No. 60/663,139 filed Mar. 17, 2005 which is explicitly incorporated by reference in its entity.

TECHNICAL FIELD OF THE INVENTION

This invention relates to an array antenna, and more particularly to an integrated mm-wave planar array antenna based on a multilayer ceramic technology such as Low Temperature Co-fired Ceramic (LTCC) technology.

BACKGROUND OF THE INVENTION

With the increasing demands of commercial mm-wave application such as Collision Avoidance Radar and Local Multi-points Distribution System (LMDS), a multi-layered large-scale array antenna has attracted some attention due to its flexibility in manufacturing, the capability of passive integration, and the low production cost. One potential application is to build a microstrip patch array antenna in a multilayer ceramic substrate. However, operating at mm-wave frequencies, a conventional microstrip patch array antenna on multilayer ceramic substrate would be less attractive because of its low element radiation efficiency and the loss from feeding network, which are caused by the relative high dielectric constant of a ceramic substrate.

Moreover, the bandwidth of a traditional patch antenna is proportional to the substrate thickness. To achieve a wider bandwidth, a thicker substrate can be used. However, working with the high dielectric constant substrate, a thicker substrate will lead to a higher surface wave loss and consequently degrade the radiation efficiency. For example, an antenna capable of achieving a 4% 2:1 VSWR bandwidth about 29 GHz on Dupont® 943 LTCC substrate (with dielectric constant of 7.5, a loss tangent of 0.002, and a thickness of 0.447 mm), the simulated radiation efficiency using IE3D™, is less than 78%.

It would, therefore, be desirable to provide an array antenna having relatively high radiation efficiency and relatively low cost.

The references cited herein are explicitly incorporated by reference in its entity.

SUMMARY OF THE INVENTION

It is an object of the present invention to provide an array antenna working at mm-wave frequency band with high radiation efficiency and low loss from feeding network by using quasi-cavity-backed patch elements and a mixed feeding network configuration.

To accomplish the object of the present invention, a novel configuration of integrated LTCC array antenna working at mm-wave frequency band has been proposed by exploiting the flexibility of LTCC technology for three-dimensional integration. The antenna array uses quasi-cavity-backed patches as radiating elements. This configuration can be used in various integrated mm-wave antenna module. In order to reduce the loss from feeding network, a mixed configuration of feeding network is proposed and verified by experiment.

According to one aspect of the present invention, an array antenna comprises a first substrate comprising a first plurality of low temperature co-fired ceramic layers; a second substrate comprising a second plurality of low temperature co-fired ceramic layers; a bottom ground plane stacked on the bottom of the second ceramic substrate; a plurality of patch antennas mounted on a top surface the first substrate, each of the patch antennas including a radiating element and two grounded grid-like conductor walls; and a feeding network coupled to each of the patch antennas.

According to another aspect of the present invention, the two grounded grid-like conductor walls are located close to two radiation edges of each of the radiating elements, respectively, and each of the grounded grid-like conductor walls comprises a plurality of metal strips and a plurality of via-holes coupling the top surface of the first substrate to the bottom ground plane.

According to another aspect of the present invention, the feeding network comprises a plurality of microstrip lines disposed in the top surface of the first substrate; and a plurality of laminated waveguides constructed in the second substrate, which is defined by an internal ground plane disposed between the first and the second substrates, the bottom ground plane; the second substrate; and a plurality of via-holes extending through the second substrate for electrically connecting the internal ground plane to the bottom ground plane, and for coupling the via-holes to each other.

In the present invention, a large scale and high gain array antenna can be built and be integrated with other mm-wave functional components in same ceramic tile by using the LTCC multilayer technology.

DETAILED DESCRIPTION OF THE INVENTION

The present invention and various advantages thereof will be described with reference to exemplary embodiments in conjunction with the drawings.

Figure 1:
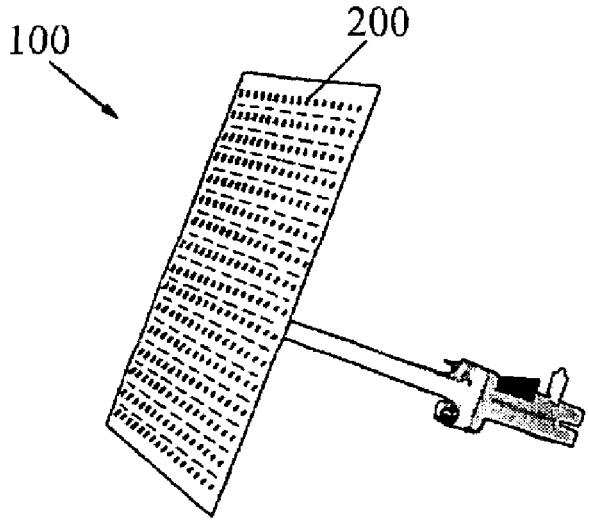
FIG. 1 is a schematic view showing an integrated multilayer ceramic array antenna according to the present invention.

FIG. 1 shows an array antenna 100 of the present invention. According to the present embodiment, the array antenna 100 comprises 256 quasi-cavity-backed patch (QCBP) antennas 200 including 16 columns and 16 rows, and a multi-layered Low Temperature Co-fired Ceramic (LTCC) substrate 500.

Figure 2:
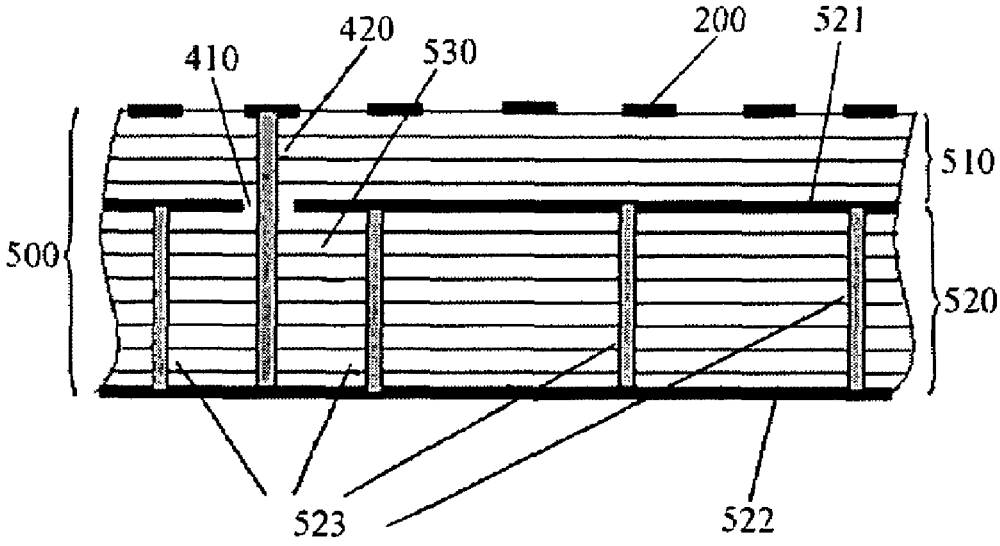
FIG. 2 is a schematic view showing a cross section of the array antenna in FIG. 1.

As shown in FIG. 2, the LTCC substrate 500 of the array antenna 100 comprises a first substrate 510 which further comprises four low temperature co-fired ceramic layers, and a second substrate 520 which further comprises eight low temperature co-fired ceramic layers. The 256 patch antennas 200 are provided on a top surface 511 of the first substrate 510. A bottom ground plane 522 is stacked on the bottom of the second ceramic substrate 520.

Figure 3:
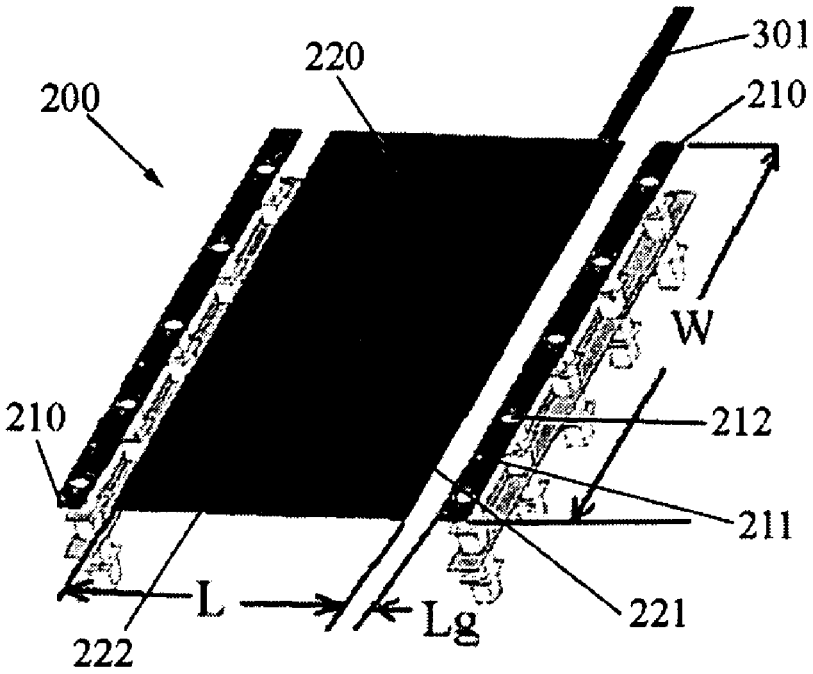
FIG. 3 is a perspective view showing a quasi-cavity-backed patch (QCBP) antenna of the array antenna according to the present invention.

Referring to FIG. 3, each patch antenna 200 of the array antenna 100 comprises a radiating element 220 and two conductor walls 210. The radiating element 220 comprises two radiation edges 221 with a length W and two non-radiation edge 222 with a length L. The conductor walls 210 are respectively located parallel to the radiation edges 221 with a separation distance Lg. The conductor walls 210 comprise a plurality of metal strips 211 and via-holes 212 extending throughout the 12 layers of the LTCC substrate 500. The metal strips 211 are coupled to the bottom ground plane 522 through the via-holes 212, which thereby forms a cavity 213 in the LTCC. Preferably, the separation distance Lg between the conductor walls 210 and their closest radiation edges 221 should be kept close to the extension length of the fringe field of the radiating element 220 in order to maximize the radiation efficiency.

According to the present embodiment, the QCBP antenna 200 having the above-mentioned configuration can achieve a better radiation performance than that of its counterpart without the cavity.

According to the present invention, a feeding network is provided in the LTCC substrate 500 and coupled to the patch antennas 200 to transmit a signal with the patch antennas 200. Owing to the feature of no radiation loss and low insertion loss, a laminated waveguide (LWG) is considered as one of the most effective transmission lines for LTCC mm-wave applications. However, as compared to the size of patch element, laminated waveguide is still too bulky to feed each element directly. To consolidate the features of laminated waveguide and patch array antenna, a mixed feeding network that consists of laminated waveguide and microstrip line is proposed in the present invention, in which the main trunk of the feeding network is implemented by laminated waveguide, whereas the branch sub feeding networks are constructed by microstrip line.

Figure 4:
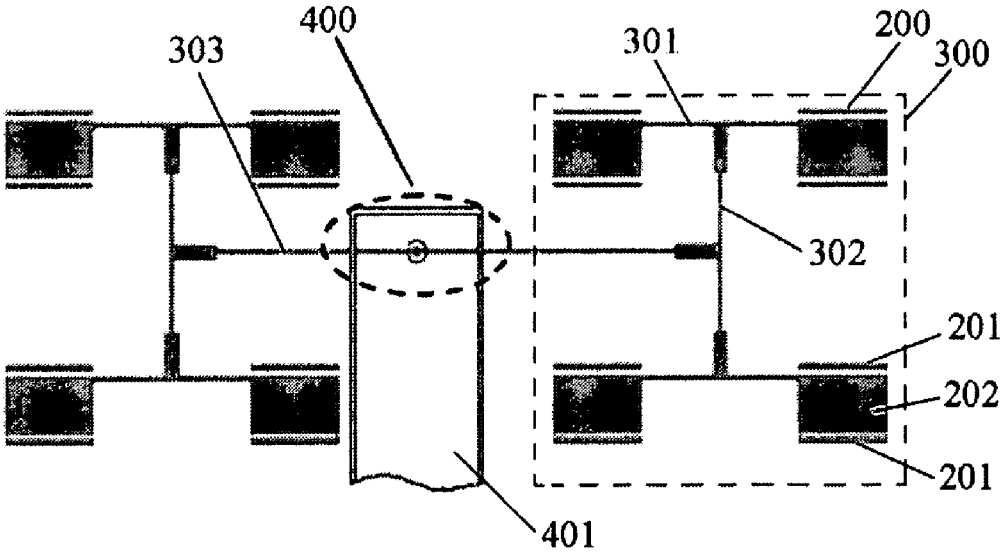
FIG. 4 is a plan view showing a sub-array of the array antenna with mixed feeding network according to the present invention.
Figure 5A:
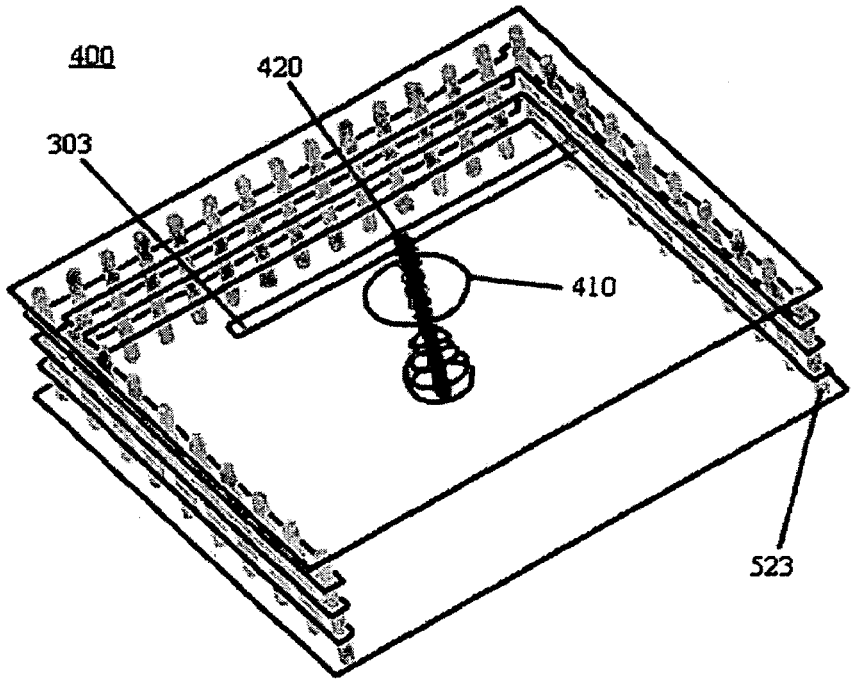
FIG. 5*a* is a perspective view showing a T-junction configuration for coupling a laminated waveguide to a microstrip line.
Figure 5B:
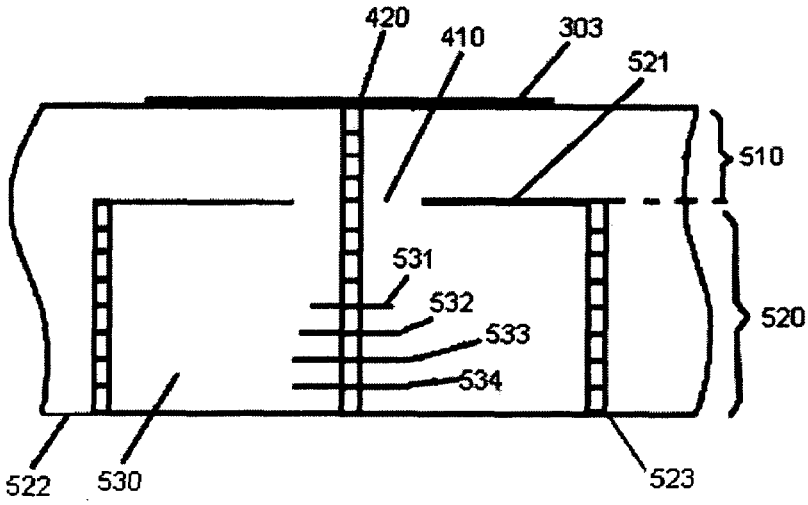
FIG. 5*b* is a schematic view showing a cross section of the T-junction configuration of FIG. 5*a;*
Figure 6:
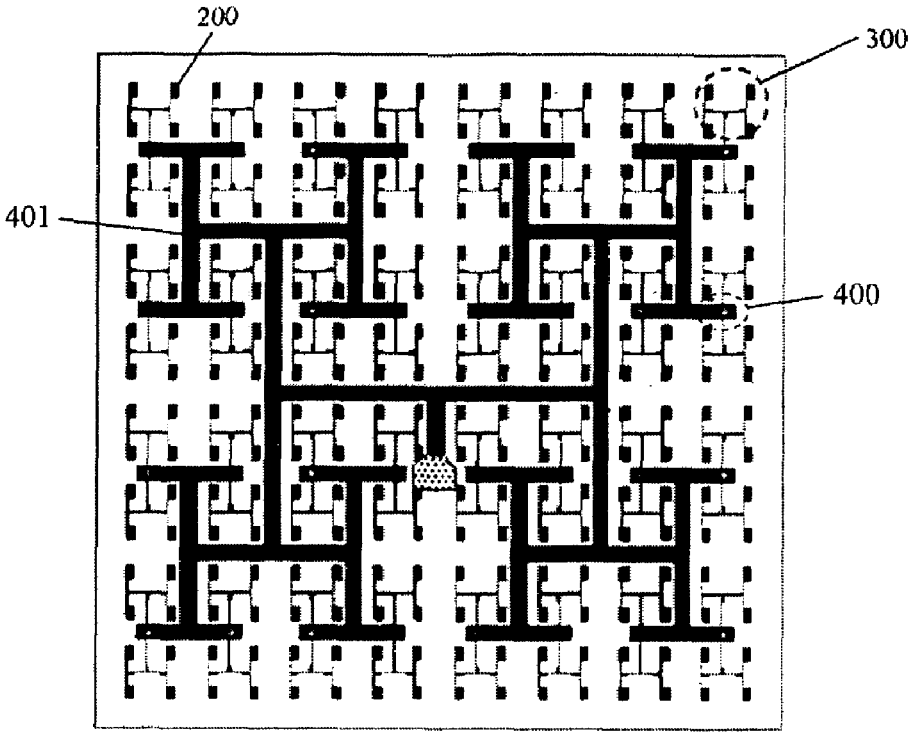
FIG. 6 is a plan view showing the array antenna with a mixed feeding network according to the present invention.

FIG. 4 shows a sub-array including 2 by 2 patch antennas of the array antenna 200 employing the mixed feeding network. FIG. 6 is a plan view showing the array antenna with a mixed feeding network. Referring to FIGS. 2, 4, and 6, in the present embodiment, a main trunk 401 which is constructed by the laminated waveguides is constructed in the second substrate 520 of the LTCC substrate 500. The main trunk 401 is coupled to two feeding lines 402 through a T-junction configuration 400, and each of the feeding lines 402 is branched out into two feeding lines 403, also, each of the feeding lines 403 is branched out into two feeding lines 404 which are connected to the patch antenna 200 of the sub-array 300. In this way, the feeding lines 402, 403, and 404 forms a sub feeding network which is constructed by the traditional microstrip lines. Moreover, an internal goround plane 521 is provided between the first substrate 510 and the second substrate 520 for shielding the microstrip lines and the LWGs.

As shown in FIGS. 2, 4, 5*a*, and 5*b*, the feeding lines 402, 403, and 404 are disposed in the top surface 511 of the first substrate 510. The laminated waveguide 530 is constructed in the second substrate 520. The laminated waveguide 530 is a cavity defined by the internal ground plane 521, the bottom ground plane 522, the second substrate 520; and a plurality of via-holes 523 extending throughout the second substrate 520 for electrically connecting the internal ground plane to the bottom ground plane.

According to the present embodiment, a through hole 420 extending throughout the 12 layers of the LTCC substrate 500 is provided to couple the laminated waveguide with the microstrip line. The through hole 420 is coupled to the microstrip line 301 and penetrated inside the laminated waveguide 530 through an opening 410 formed on the internal ground plane 521 of the second substrate 520. Four metallic pads 531, 532, 533, 534 are coupled to the filled through hole, which are stacked on a lower four layers of the second substrate 520. The dimensions of the metallic pads 531, 532, 533, 534 are configured, so that the diameter of the pad 531≦the diameter of the pad 532≦the diameter of the pad 533≦the diameter of the pad 534, which thereby forms a bell-shape probe end.

As shown in FIG. 2, the sub feeding network of the 2 by 2 subs-arrays utilize traditional microstrip lines, and all the 2 by 2 sub arrays are coupled to each other through the laminated waveguides. The microstrip lines and the laminated waveguides are separated by an internal ground plane.

Figure 7:
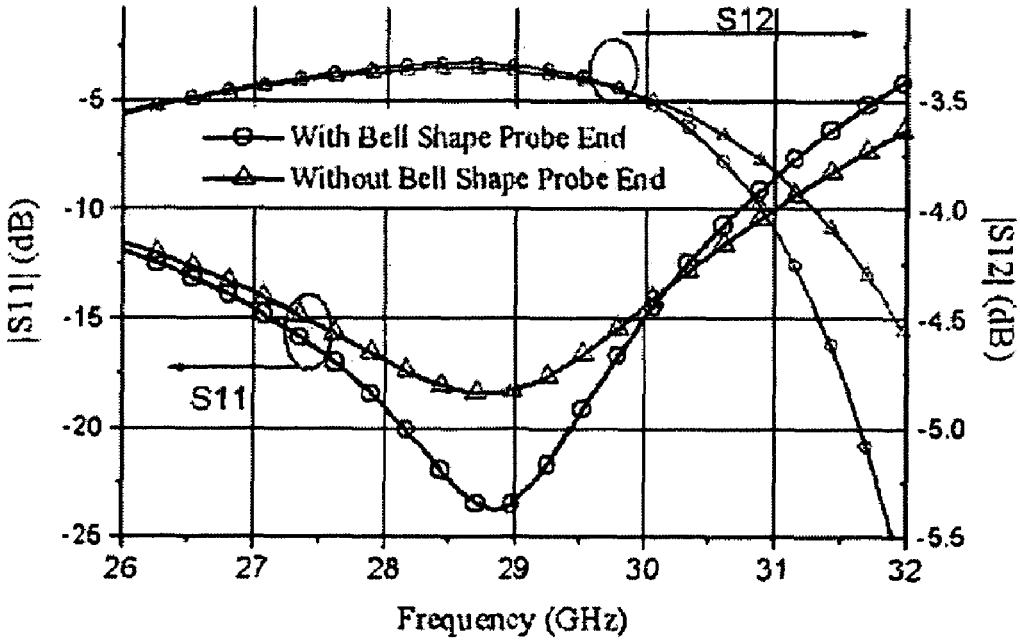
FIG. 7 is a graph showing the simulated result of the T-junction adopting metallic pads with and without bell-shape end.
Figure 8:
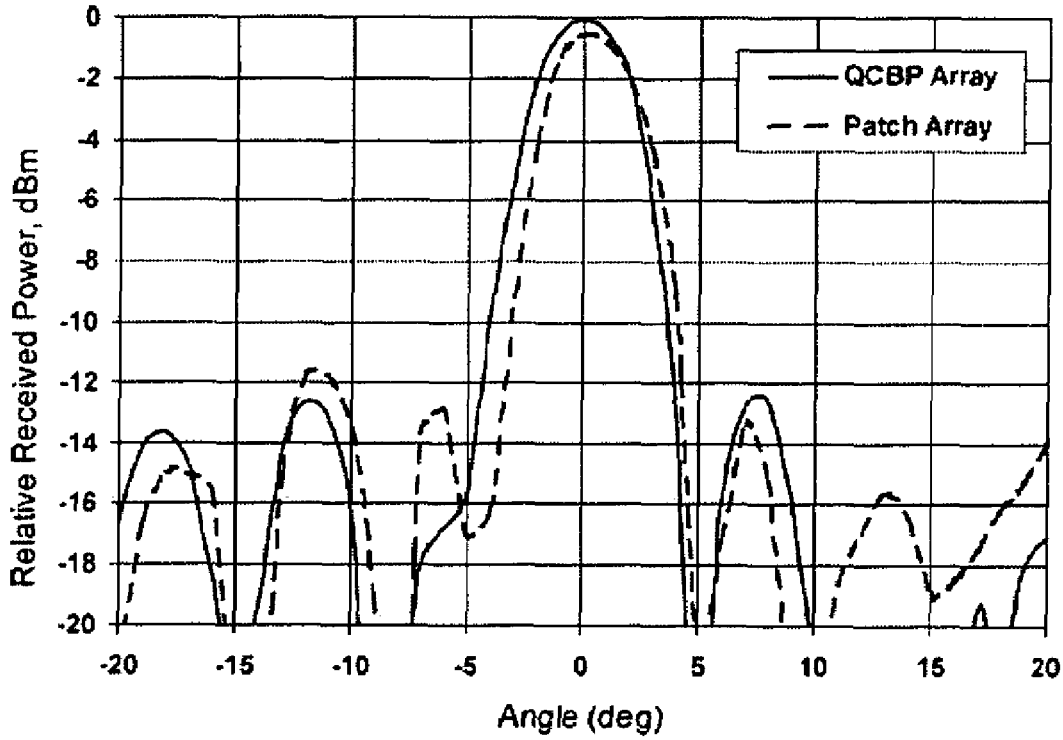
FIG. 8 is a graph showing measured E-plane radiation patterns of the array using patch elements and the QCBP elements.

According to another embodiment of the invention, the T-junction is built in a 12-layers LTCC substrate with the thickness of 4.4 mils for each layer. The cross-section of the laminated waveguide 530 is 140 mils by 32.5 mils. The via-holes 523 are provided with 3.5 mils in diameter and 15 mils center-to-center distance. The microstrip line used is a 4 mils wide metal strip with impedance of 100Ω. The diameters of the through hole 420, the opening 410, and the metallic pads 531, 532, 533, 534 are (unit: mils) 2.75, 13, 4.8, 5.8, 7.8, and 7.8, respectively. FIG. 7 shows the simulated result of the proposed T-junction. A T-junction adopting a probe without bell-shape end is also investigated. The distances from center of probe to the shorting wall are 60 mils and 64 mils, respectively, for the probe with and without bell-shape end. According to the simulated result, a more than 10% bandwidth defined at 15 dB return loss is obtained for the T-junction employing a bell-shape probe end at the center frequency of 29 GHz, whereas the insertion loss is about 0.3 dB at the center frequency A prototype of a patch antenna array with proposed quasi-cavity-backed elements and a prototype of the same patch antenna array without cavity-backing are fabricated using a 12-layer substrate of Dupont® 943 Green Tape™. An identical feeding network structure is used in the two prototypes. In the 12-layer substrate, the LWG feeding network is built in the lower eight layers and the antenna elements and microstrip line feeding network is built in the upper four layers. The thickness for each layer is 0.11 mm. The 16×16 elements in the array antenna are excited equally. To prove the concept of the proposed mixed feeding network and also save the real estate for other loaded LWG components, only the first branch of the main trunk is implemented by LWG in the experimental array. The two types of required transitions, namely the transition from air waveguide to LWG and the T-junction from LWG to microstrip line, have been integrated in the experimental feeding network.

Simulated results obtained from ANSOFT® HFSS™ show that the insertion losses of the proposed mixed feed network, and a traditional microstrip edge feeding network are 3.7 dB and 9.6 dB respectively, where the cross-sectional dimension of LWG is 2.5 mm by 0.22 mm, and the microstrip trace width of 100 ohm microstrip line used in the microstrip line feeding network is 0.1 mm. The simulated insertion loss of the experimental feeding network is 6.63 dB. Although the experimental feeding network is just a portion of the proposed mixed feeding network, the improvement over the microstrip line feeding network is significant enough to verify the concept of the proposed mixed feeding network. Based on the calculated radiation efficiency presented in Table 1, it can be concluded, by simulation, that the gain of a QCBP array with mixed feeding network and a conventional element array with a microstrip line feeding network is about 26.46 dB and 20.42 dB, respectively. Even for the experimental array, in which LWG is used only for the first branch of the feeding network and the quasi-cavity-backed elements are used, about 24.23 dB gain can be achieved.

FIG. 7 illustrates the measured E-plane radiation pattern of both fabricated array prototypes. It can be observed that the improvement of the measured gain of the one with quasi-cavity-backed elements over the one without the cavity-backed elements is about 0.62 dB, which is slightly less than the theoretic gain of 0.84 dB as revealed in Table 1. The measured gain to the experimental QCBP array and patch array are 23.53 dB and 22.91 dB, respectively. The measured gain is about 0.7 dB less than the simulated result. This difference is possibly caused by the mismatch of the junctions in feeding network, which is not counted in the loss analysis.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

REFERENCES

[1] D. R. Jackson, J. T. Williams, A. K. Bhattacharyya, R. L. Smith, S. J. Buchheit, and S. A. Long, "Microstrip Patch Designs That Do Not Excite Surface Waves," *IEEE Trans. Antennas and Propagations*, Vol. 41, No. 8, pp 1026-1037, August, 1993.

[2] H. Uchimura, T. Takenoshita, and M. Fujii, "Development of a Laminated Waveguide," *IEEE Trans. Microwave Theory Tech.*, Vol. 46, No. 12, pp 2438-2443, December, 1998.

[3] Y. Huang, K.-L. Wu and M. Ehlert, "An Integrated LTCC Laminated Waveguide-to-Microstrip Line T-Junction," *IEEE Microwave and Wireless Comp. Lett.*, vol. 13, August, 2003.

[4] Y. Huang, K.-L. Wu, "A Broadband LTCC Integrated Transition of Laminated Waveguide to Air-Filled Waveguide For Millimeter Wave Applications," *IEEE Trans. Microwave Theory Tech.*, Vol. 51, pp 1613-1617, May, 2003.

The invention claimed is:

1. An array antenna, comprising:

a first substrate comprising a first multilayer;

a second ceramic substrate comprising a second multilayer;

a bottom ground plane stacked on the bottom of the second ceramic substrate;

a plurality of patch antennas mounted on a top surface the first substrate, each of the patch antennas including a radiating element and two grounded grid-like conductor walls; and a feeding network coupled to each of the patch antennas.

2. The array antenna of claim 1, wherein the first multilayer comprises a first plurality of ceramic layers, and the second multilayer comprises a second plurality of ceramic layers.

3. The array antenna of claim 2, wherein the first and the second plurality of ceramic layers are Low Temperature Co-fired Ceramic layers.

4. The array antenna of claim 3, wherein the two grounded grid-like conductor walls are located close to two radiation edges of each of the radiating elements, respectively, and each of the grounded grid-like conductor walls comprises a plurality of metal strips and a plurality of via-holes coupling the top surface of the first substrate to the bottom ground plane.

5. The array antenna of claim 4, wherein the distance between the radiation edges of each of the radiating elements and the conductor walls close to the edges is approximate to an extension length of the fringe field of the radiating elements, so as to maximize the radiation efficiency of the array antenna.

6. The array antenna of claim 3, wherein an internal ground plane is disposed between the first and the second substrates for shielding the first substrate and the second substrate.

7. The array antenna of claim 6, wherein the feeding network comprises:

a plurality of microstrip lines disposed in the top surface of the first substrate; and a plurality of laminated waveguides constructed in the second substrate, which is defined by the internal ground plane;

the bottom ground plane;

the second substrate; and a plurality of via-holes extending through the second substrate for electrically connecting the internal ground plane to the bottom ground plane, and for coupling the via-holes to each other.

8. The array antenna of claim 7, wherein the patch antennas are connected to each other through the microstrip lines, and the microstrip lines are coupled to the laminated waveguides through a T-junction configuration.

9. The array antenna of claim 8, wherein the T-junction configuration comprises:

an opening formed on the internal ground plane stacked on the top surface of the second substrate;

a through hole which is coupled to the microstrip lines and penetrated inside the laminated waveguides though the opening on the internal ground plane; and a plurality of metallic pads coupled to the filled through hole, which are stacked on a lower plurality of the second plurality of low temperature co-fired ceramic layers of the second substrate.

10. The array antenna of claim 9, wherein diameters of the metallic pads is increased from top to bottom, so that the metallic pads can form a bell-shape probe end.

11. The array antenna of claim 8, wherein each four patch antennas forms a two by two sub-array, the patch antennas of an identical sub-array are coupled to each other through the microstrip lines, and the sub-arrays of the array antenna are coupled to each other through the laminated waveguides.

12. The array antenna of claim 1, wherein the first substrate comprises four ceramic layers and the second substrate comprises eight ceramic layers.

13. An array antenna, comprising:

a first substrate comprising a first multilayer;

a second ceramic substrate comprising a second multilayer;

a bottom ground plane stacked on the bottom of the second ceramic substrate;

a plurality of radiating elements mounted on a top surface the first substrate; and a mixed feeding network coupled to each of the radiating elements, which comprises a plurality of microstrip lines disposed in the top surface of the first substrate, through which the radiating elements are coupled to each other; and a plurality of laminated waveguides coupled to the microstrip lines, the laminated waveguides being constructed in the second substrate and defined by an internal ground plane stacked on a top surface of the second substrate;

the bottom ground plane;

the second substrate; and a plurality of via-holes extending through the second substrate for coupling the internal ground plane to the bottom ground plane, and for coupling the via-holes to each other.

14. The array antenna of claim 13, wherein the first multilayer comprises a first plurality of ceramic layers, and the second multilayer comprises a second plurality of ceramic layers.

15. The array antenna of claim 14, wherein the first and the second plurality of ceramic layers are Low Temperature Co-fired Ceramic layers.

16. The array antenna of claim 15, wherein each four patch antennas of the array antenna forms a 2 by 2 sub-array, the patch antennas of each sub-array are coupled to each other through the microstrip lines, and the sub-arrays are coupled to each other though the laminated waveguides.

17. The array antenna of claim 15, wherein the laminated waveguides are coupled to the microstrip lines through a T-junction configuration, which comprises:

an opening formed on the internal ground plane stacked on the top surface of the second substrate;

a through hole which is coupled to the microstrip lines and penetrated inside the laminated waveguides through the opening on the internal ground plane; and a plurality of metallic pads coupled to the filled through hole, in which the metallic pads are stacked the second plurality of low temperature co-fired ceramic layers of the second substrate, and the radius of each of the metallic pads is configured so that the metallic pads can form a bell-shape probe end.

* * * * *